US012546051B2

(12) United States Patent
Kim et al.

(10) Patent No.: US 12,546,051 B2
(45) Date of Patent: Feb. 10, 2026

(54) WASHING APPARATUS AND CONTROLLING METHOD THEREOF

(71) Applicant: Samsung Electronics Co., Ltd., Suwon-si (KR)

(72) Inventors: Namgil Kim, Suwon-si (KR); Junhyun Park, Suwon-si (KR); Seunghun Lee, Suwon-si (KR); Youngjin Um, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 154 days.

(21) Appl. No.: 18/351,884

(22) Filed: Jul. 13, 2023

(65) Prior Publication Data

US 2023/0357977 A1 Nov. 9, 2023

Related U.S. Application Data

(63) Continuation of application No. PCT/KR2022/000915, filed on Jan. 18, 2022.

(30) Foreign Application Priority Data

Feb. 8, 2021 (KR) ..... 10-2021-0017771

(51) Int. Cl.
*D06F 37/40* (2006.01)
*D06F 34/14* (2020.01)
(Continued)

(52) U.S. Cl.
CPC ..... *D06F 37/40* (2013.01); *D06F 34/14* (2020.02); *D06F 2103/24* (2020.02); *D06F 2105/48* (2020.02)

(58) Field of Classification Search
CPC ..... D06F 37/30; D06F 37/304; D06F 37/40
See application file for complete search history.

(56) References Cited

U.S. PATENT DOCUMENTS 5,809,808 A * 9/1998 Andriano ..... D06F 37/40 74/25
7,409,737 B2 8/2008 Cho et al.
(Continued)

FOREIGN PATENT DOCUMENTS

JP 10-263272 A 10/1998
JP 4741690 B2 8/2011
(Continued)

OTHER PUBLICATIONS

JPH10263272A Machine Translation (Year: 1998).*
(Continued)

*Primary Examiner* — Spencer E. Bell
(74) *Attorney, Agent, or Firm* — Jefferson IP Law, LLP

(57) ABSTRACT

A washing apparatus is provided. The washing apparatus includes a main body having a door, a spin basket disposed inside the main body and rotating about a rotary shaft, a motor providing power to the rotary shaft, a spring clutch including a first core rotating in conjunction with the motor and a second core rotating in conjunction with the rotation shaft, and selectively transmitting power of the motor to the spin basket, a processor, and a sensor that measures revolutions per minute (RPM) of the spring clutch, and when the driving of the motor based on an input signal is completed, the processor controls to stop the driving of the motor, and after stopping the driving of the motor, controls the motor to be re-driven for a preset driving time based on a measurement value of the sensor.

16 Claims, 7 Drawing Sheets

(51) Int. Cl.
*D06F 103/24* (2020.01)
*D06F 105/48* (2020.01)

(56) References Cited

U.S. PATENT DOCUMENTS

| | | | |
|---|---|---|---|
| 9,328,444 | B2 | 5/2016 | Lee et al. |
| 10,246,809 | B2 | 4/2019 | Kim et al. |
| 2005/0081573 | A1 | 4/2005 | Han |
| 2014/0236363 | A1 | 8/2014 | Ha et al. |
| 2015/0240404 | A1 | 8/2015 | Kim et al. |
| 2018/0230636 | A1 | 8/2018 | Onishi et al. |

FOREIGN PATENT DOCUMENTS

| | | | |
|---|---|---|---|
| JP | 2018-023499 | A | 8/2016 |
| KR | 10-2000-0043390 | A | 7/2000 |
| KR | 10-0493301 | B1 | 6/2005 |
| KR | 10-1053590 | A | 8/2011 |
| KR | 10-1241888 | A | 3/2013 |
| KR | 10-2014-0103608 | A | 8/2014 |
| KR | 10-2015-0027928 | A | 3/2015 |
| KR | 10-2016-0094135 | A | 8/2016 |
| KR | 10-2018-0129342 | A | 12/2018 |

OTHER PUBLICATIONS

International Search report and written opinion dated May 3, 2022, issued in International Application No. PCT/KR2022/000915.
Korean Office Action dated Nov. 27, 2025, issued in Korean Application No. 10-2021-0017771.

* cited by examiner

WASHING APPARATUS AND CONTROLLING METHOD THEREOF

CROSS-REFERENCE TO RELATED APPLICATION(S)

This application is a continuation application, claiming priority under § 365(c), of an International application No. PCT/KR2022/000915, filed on Jan. 18, 2022, which is based on and claims the benefit of a Korean patent application number 10-2021-0017771, filed on Feb. 8, 2021, in the Korean Intellectual Property Office, the disclosure of which is incorporated by reference herein in its entirety.

BACKGROUND

1. Field

The disclosure relates to a washing apparatus and a controlling method thereof. More particularly, the disclosure relates to a washing apparatus identifying whether a slip occurred in a spring clutch, and a controlling method thereof.

2. Description of Related Art

A washing apparatus is a machine that automatically washes laundry such as clothes by using electricity, and it is formed such that washing, rinsing, draining, and spin-drying cycles are automatically performed by a processor.

A general washing apparatus includes a main body including a door, a washing tub housing washing water, a spin basket that is rotatably arranged inside the washing tub, a pulsator that is rotatably arranged inside the spin basket, and a motor and a processor for driving the spin basket and the pulsator, etc.

Contaminants in laundry introduced into the spin basket may be removed as the laundry is agitated with the washing water by the pulsator and the spin basket rotating by the driving force of the motor.

The motor and the pulsator may be shaft-coupled through a washing shaft, and the pulsator may rotate by the driving force of the motor. Also, the spin basket may selectively receive the driving force from the motor through a clutch, and rotate about a rotary shaft. Through this, the washing apparatus may operate in a washing mode wherein the washing apparatus is operated through a rotation of the pulsator and a selective rotation of the spin basket, and in a spin-drying mode wherein the pulsator and the spin basket rotate together.

As types of the clutch, there are a spring type, a coupling type, etc. Among them, in a spring clutch of the spring type, a slip may occur in the spring, and thus a problem that the sensor cannot correctly measure the revolutions per minute (RPM) of the spin basket may occur. When a slip of the spring clutch occurs, there is a problem that the processor determines that the spin basket has stopped even though the spin basket is rotating, and transmits a washing completion signal, and the user's hand or arm may get hurt by the spin basket that is rotating.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a washing apparatus identifying whether a slip occurred in a spring clutch, and a controlling method thereof.

Additional aspects will be set forth in part in the description which follows and, in part, will be apparent from the description, or may be learned by practice of the presented embodiments.

In accordance with an aspect of the disclosure, a washing apparatus is provided. The washing apparatus includes a main body having a door, a spin basket disposed inside the main body, the spin body being configured to rotate about a rotary shaft, a motor providing power to the rotary shaft of the spin basket, a spring clutch including a first core rotating in conjunction with the motor and a second core rotating in conjunction with the rotation shaft, the spring clutch being configured to selectively transmit power of the motor to the spin basket, a processor, and a sensor measuring an RPM of the spring clutch and providing the RPM to the processor, the processor being configured to, based on a driving of the motor according to an input signal being completed, control the motor to stop the driving of the motor, and after stopping the driving of the motor, control the motor to be re-driven for a preset driving time based on a measurement value of the sensor.

In this case, the processor may, based on the re-driving of the motor being completed, identify whether a slip occurred in the spring clutch based on the measurement value of the sensor, and based on identifying that a slip did not occur in the spring clutch, generate a completion signal.

In this case, the processor may, based on identifying that a slip of the spring clutch occurred, control the motor to be re-driven during the preset driving time again after a preset standby time.

In this case, the spring clutch may include a case fixed to the lower part of the spin basket, and a spring that is arranged on a coupling shaft of the first core and the second core, and selectively fixes the first core and the second core.

In this case, the sensor may be a sensor sensing a relative rotation of the case of the spring clutch and the first core.

Meanwhile, whether a slip occurred in the spring clutch may be identified based on whether the measurement value of the sensor is smaller than or equal to a preset second value after the processor drove the motor during the preset driving time.

In this case, the preset second value may be a value between 20 and 100.

Meanwhile, the processor may, based on identifying a slip of the spring clutch, identify whether a slip occurred in the spring clutch again after waiting as much as the preset standby time.

Meanwhile, the preset driving time may be a time between 0.5 second and 3 seconds.

Meanwhile, the main body may include a locking device of the door, and the processor may control the opening of the door by controlling the locking device based on the input signal, and release the locking of the locking device based on the completion signal.

In this case, the processor may release the locking of the locking device after waiting as much as the preset standby time based on the completion signal.

In accordance with another aspect of the disclosure, a controlling method of a washing apparatus including a spring clutch selectively transmitting power from a motor to a spin basket is provided. The controlling method includes the operations of, based on receiving an input signal, driving the motor and controlling the spring clutch to transmit power to a rotation shaft of the spin basket to rotate the spin basket, based on the driving of the motor according to the input signal being completed, controlling the motor to stop the driving of the motor, identifying an RPM of the spring clutch, and based on the RPM of the spring clutch after the stopping of the driving of the motor, re-driving the motor during a preset driving time.

In this case, the operation of identifying the RPM of the spring clutch may be an operation of identifying whether the measured RPM is smaller than or equal to a preset first value.

In this case, the preset driving time may be a time between 0.5 second and 3 seconds.

Meanwhile, the controlling method of a washing apparatus includes the operations of, after the operation of re-driving the motor during the preset driving time, identifying whether the RPM of the spring clutch is smaller than or equal to a second value, and generating a completion signal.

Meanwhile, in the operation of identifying whether the RPM of the spring clutch is smaller than or equal to the second value, based on identifying a slip of the spring clutch, it may be identified whether a slip occurred in the spring clutch again after waiting as much as the preset standby time.

In this case, the first standby time may be a time between 20 seconds and 1 minute.

Meanwhile, in the operation of driving the motor based on receiving the input signal, the opening of the door may be controlled by controlling the locking device of the door of the main body of the washing apparatus before driving the motor, and in the operation of generating the completion signal, the locking of the locking device may be released after waiting as much as the preset standby time.

In this case, the second value may be a value between 20 and 100, and the preset standby time may be a time between 1 second and 5 seconds.

Meanwhile, the input signal may be a signal driving a spin-drying cycle of the washing apparatus.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

Figure 1:
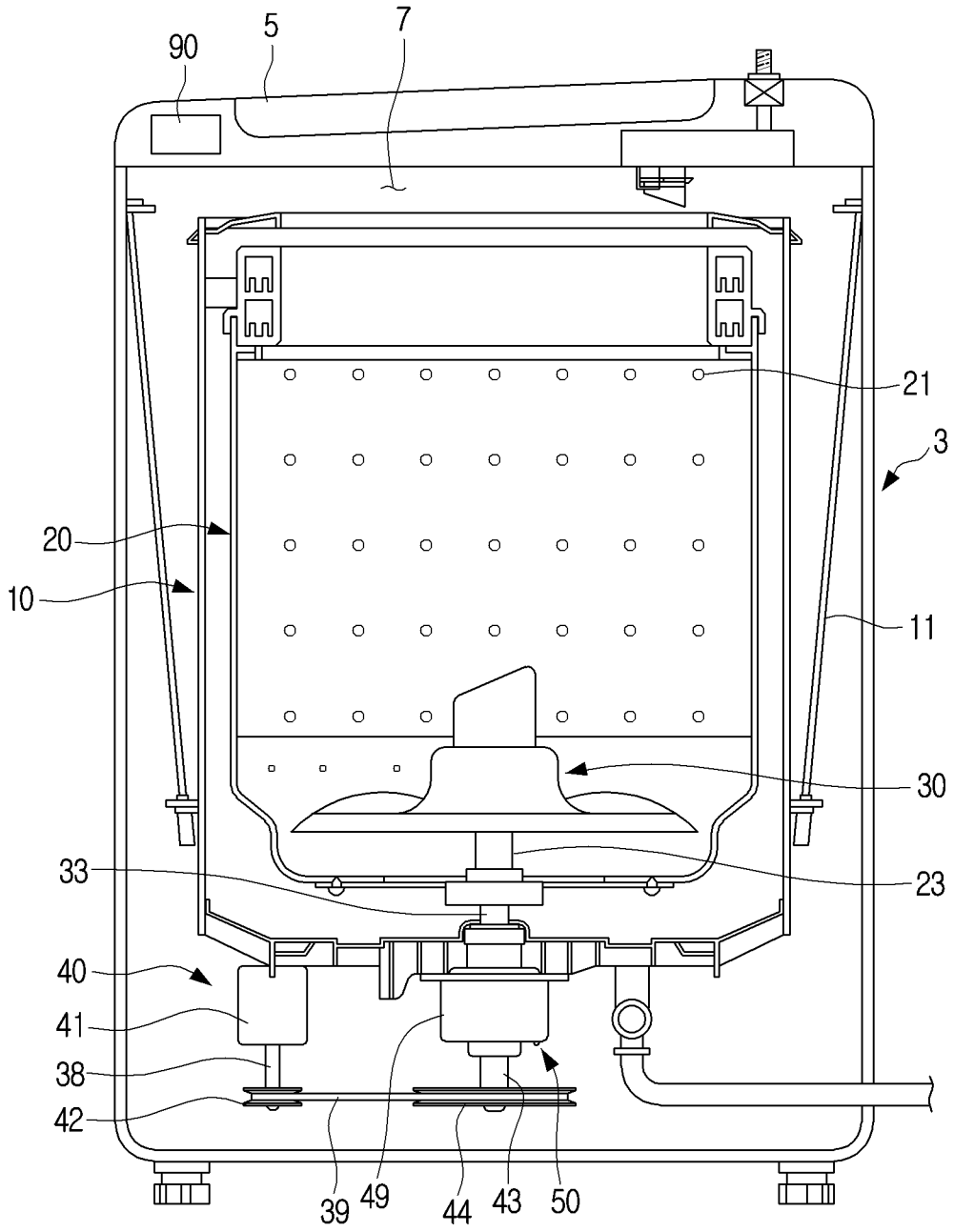
FIG. 1 is a side cross-sectional view of a washing apparatus according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As terms used in the embodiments of the disclosure, general terms that are currently used widely were selected as far as possible, in consideration of the functions described in the disclosure. However, the terms may vary depending on the intention of those skilled in the art or previous court decisions, emergence of new technologies, etc. Also, in particular cases, there may be terms that were arbitrarily designated by the applicant, and in such cases, the meaning of the terms will be described in detail in the relevant descriptions in the disclosure. Accordingly, the terms used in the disclosure should be defined based on the meaning of the terms and the overall content of the disclosure, but not just based on the names of the terms.

Further, various modifications may be made to the embodiments of the disclosure, and there may be various types of embodiments. Accordingly, specific embodiments will be illustrated in drawings, and the embodiments will be described in detail in the detailed description. However, it should be noted that the various embodiments are not for limiting the scope of the disclosure to a specific embodiment, but they should be interpreted to include all modifications, equivalents, or alternatives of the embodiments included in the ideas and the technical scopes disclosed herein. Meanwhile, in case it is determined that in describing embodiments, detailed explanation of related known technologies may unnecessarily confuse the gist of the disclosure, the detailed explanation will be omitted.

In addition, terms such as "first," "second," etc. may be used to describe various elements, but the terms are not intended to limit the elements. Such terms are used only to distinguish one element from another element.

Also, singular expressions include plural expressions, as long as they do not clearly mean differently in the context.

In addition, in the disclosure, terms such as "include" and "consist of" should be construed as designating that there are such characteristics, numbers, steps, operations, elements, components, or a combination thereof described in the specification, but not as excluding in advance the existence or possibility of adding one or more of other characteristics, numbers, steps, operations, elements, components, or a combination thereof.

Further, in the disclosure, "a module" or "a part" performs at least one function or operation, and may be implemented as hardware or software, or as a combination of hardware and software. Also, a plurality of "modules" or a plurality of "parts" may be integrated into at least one module and implemented as at least one processor 90, except "a module" or "a part" that needs to be implemented as specific hardware.

Hereinafter, embodiments of the disclosure will be described in detail with reference to the accompanying drawings to the extent that those having ordinary skill in the art to which the disclosure belongs can easily carry out the embodiments. However, the disclosure may be implemented in various different forms, and are not limited to the embodiments described herein. Also, in the drawings, parts that are not related to explanation were omitted, for explaining the disclosure clearly, and throughout the specification, similar components were designated by similar reference numerals.

Hereinafter, a washing apparatus 1 and a controlling method thereof according to the disclosure will be described in detail with reference to FIGS. 1 to 7.

FIG. 1 is a side cross-sectional view of a washing apparatus according to an embodiment of the disclosure.

Referring to FIG. 1, a washing apparatus 1 may include a main body 3, a washing tub 10, a spin basket 20, a pulsator 30, and a driving device 40.

The washing apparatus 1 is a machine that washes clothes by using electric power, and based on the location of an inlet 7 and the rotating direction of the washing tub 10, etc., it may be classified into a top-loading type wherein the inlet 7 is generally provided in the upper part of the main body 3 and the rotary shaft of the washing tub 10 is perpendicular to the ground surface, and a front-loading type wherein the inlet 7 is provided on the front surface of the main body 3 and the rotary shaft of the washing tub 10 is horizontal to the ground surface. A washing apparatus of the top-loading type may also be referred to as 'a general washing apparatus' or 'a top-loader washing apparatus,' and a washing apparatus of the front-loading type may also be referred to as 'a drum washing apparatus.'

As a washing apparatus 1 of the front-loading type, there are an eddy type including a pulsator 30 in the lower part of the inside of the spin basket 20, and an agitation type including an agitation column (not shown) in the center part of the spin basket 20. Meanwhile, although FIG. 1 was illustrated based on a washing apparatus of an eddy top-loading type, the washing apparatus 1 and the controlling method thereof according to the disclosure can be applied without being limited thereto.

The main body 3 forms the exterior of the washing apparatus 1, and it may have a cuboid shape, and in the upper part of the main body 3, a laundry inlet 7 is provided such that laundry can be introduced into the washing tub 10. In the upper part of the main body 3, a door 5 that can open or close the laundry inlet 7 may be provided.

On the upper surface of the main body 3, a control panel wherein a display part and a plurality of manipulation buttons are provided is provided. Also, on the main body 3, a processor 90 that can perform a washing cycle, a rinsing cycle, a spin-drying cycle, and a boiling cycle by controlling the washing apparatus 1 is provided. The processor 90 may control the driving of a motor 41, a clutch 43, etc. by controlling a driving driver 51 of the driving device 40 based on an input signal input into the control panel.

The main body 3 may include a locking device 61 controlling opening and closing of the door 5, and the locking device 61 may be controlled by the processor 90. While the washing apparatus 1 is being driven, the processor 90 may control the locking device 61 of the door 5 to limit the opening of the door 5 such that the door 5 is not opened, and when the driving is completed, the processor 90 may release the locking of the locking device 61 of the door 5.

The washing tub 10 is installed inside the main body 3, and is formed to house washing water of a specific amount. Also, the washing tub 10 is supported with respect to the main body 3 by a suspension device 11, and makes vibration generated at the washing tub 10 at the time of washing reduced. In the lower part of the washing tub 10, a washing shaft 33 and a rotary shaft 23 of the spin basket 20 are installed to rotatably penetrate.

The spin basket 20 is formed in an approximately cylindrical shape with a hollow, and is provided inside the washing tub 10 of the main body 3, and is installed to be rotatable about the rotary shaft. On the side surface of the spin basket 20, a plurality of through holes 21 through which washing water can pass are provided. Accordingly, the washing water in the spin basket 20 may move to the washing tub 10 through the plurality of through holes 21, and the washing water in the washing tub 10 may enter the spin basket 20. The bottom surface of the spin basket 20 is coupled with the rotary shaft 23, and when the rotary shaft 23 of the spin basket 20 rotates, the spin basket 20 rotates integrally.

The pulsator 30 is installed to be rotatable separately from the spin basket 20 on the bottom inside the spin basket 20, and agitates the laundry introduced into the spin basket 20 together with washing water. The pulsator 30 is connected to the driving device 40 by the washing shaft 33, and when a rotational force is generated from the driving device 40, the washing shaft 33 rotates, and when the washing shaft 33 rotates, the pulsator 30 rotates integrally with the washing shaft 33. The pulsator 30 includes a plurality of wings, and when the pulsator 30 rotates forward and backward during a washing cycle and a rinsing cycle, a washing water current is generated by the plurality of wings.

The driving device 40 is installed in the lower part of the pulsator 30, i.e., the lower part of the washing tub 10, and generates a rotational force rotating the pulsator 30 and the spin basket 20. Such a driving device 40 may be implemented as a motor 41, a clutch 43, and a driving driver 51. The driving device 40 is provided in the center part of the lower part of the washing tub 10 such that it can selectively transmit the power of the motor 41 to the spin basket 20. The detailed configuration of the driving device 40 will be described later with reference to FIG. 2.

During a washing cycle and a rinsing cycle, the power of the motor 41 is not transmitted to the spin basket 20 by the clutch 43, and thus only the pulsator 30 can rotate forward and backward. However, during a spin-drying cycle, the power of the motor 41 is transmitted to the spin basket 20 by the clutch 43, and thus the pulsator 30 and the spin basket 20 simultaneously rotate in one direction. As the motor 41, various kinds of motors that can control rotation speed diversely such as a brushless direct current (BLDC) motor can be used.

The motor 41 consists of a housing, a stator, a rotor, and a coil wound around the stator, and when an electric current is applied to the coil wound around the stator, magnetic flux is generated, and it may rotate the rotor by interacting with the rotor electromagnetically. The motor 41 may include a rotary shaft 38 that can rotate while being coupled with the rotor. The rotor of the motor 41 may rotate the rotary shaft 38 by using the rotary shaft 38 as the rotating axis. Then, the rotary shaft 38 may be coupled with a first pulley 42 and rotate together.

The motor 41 may rotate the first pulley 42 connected to the rotary shaft 38, and the first pulley 42 may transmit the power of the motor 41 to the clutch 43 as it is in conjunction with a second pulley 44 through a belt 39.

The clutch 43 may receive the power of the motor 41, and selectively transmit the power of the motor 41 to the rotary shaft 23 of the spin basket 20 or the washing shaft 33. The configuration of the clutch 43 will be described in detail with reference to FIG. 2.

A sensor 50 may measure the RPM of the clutch 43, and provide it to the processor 90. The sensor 50 may be arranged on a fixed case 49 of the clutch 43, and measure the RPM of the second pulley 44 or a core 45 of the clutch 43 based on the case 49. Alternatively, although not illustrated in the drawings, the sensor 50 may be arranged within a rotating area of the clutch 43 such as the second pulley 44 or the core 45 of the clutch 43, etc., and the sensor 50 may measure the RPM of the clutch 43 while the sensor 50 is rotating. The sensor 50 may transmit the measured sensing value to the processor 90, and the processor 90 may identify the RPM of the spin basket 20 based on the sensing value.

Figure 2:
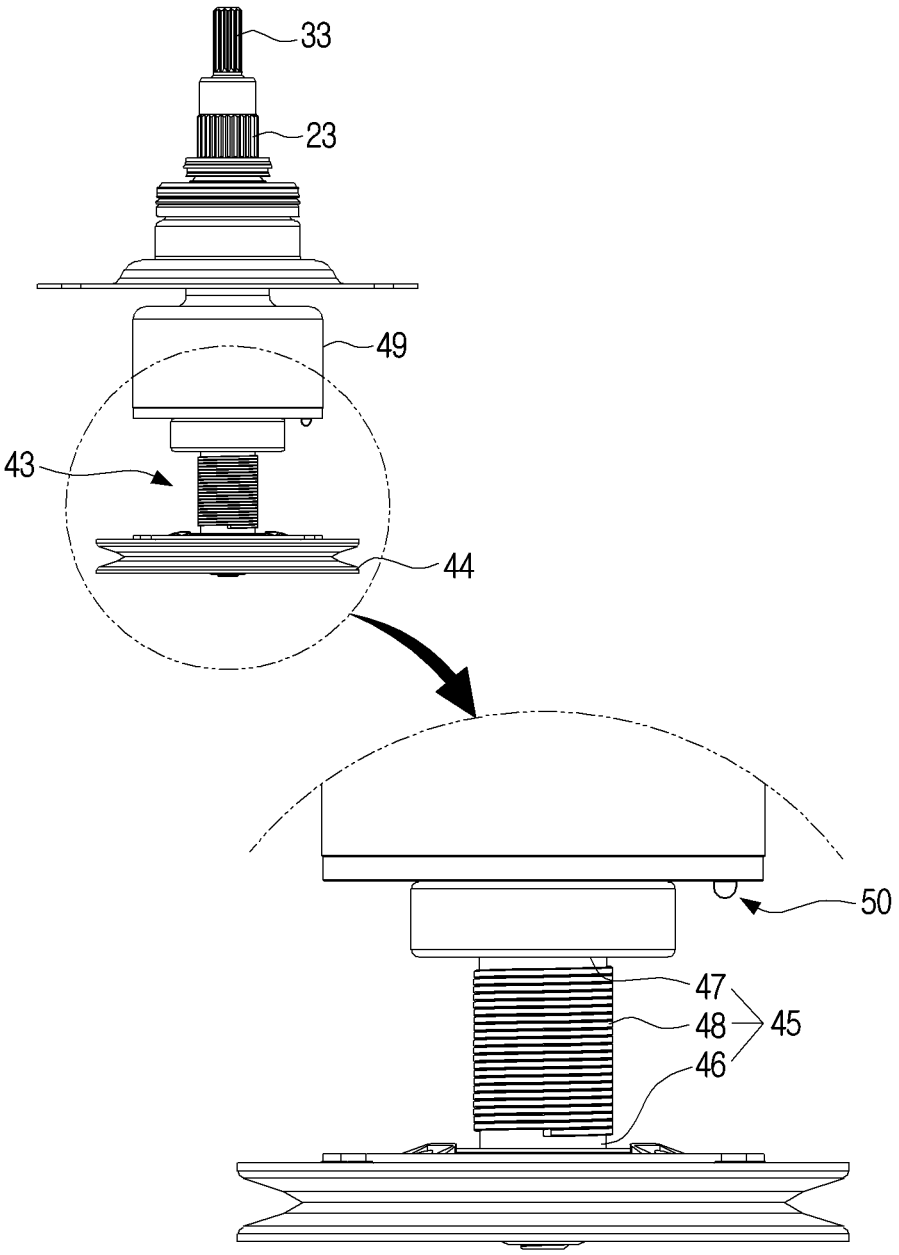
FIG. 2 is a perspective view of a clutch according to an embodiment of the disclosure.

FIG. 2 is a perspective view of a clutch according to an embodiment of the disclosure.

Referring to FIG. 2, a clutch 43 may include a first core 46, a second core 47, and a spring 48.

The clutch 43 according to the disclosure may be a spring clutch 43 that selectively transmits the power of the motor 41 by the spring 48 coupled to the coupling shaft of the first core 46 and the second core 47 of the core 45. Hereinafter, explanation will be described based on 'the spring clutch 43' as the clutch 43 included by the washing apparatus 1 according to the disclosure.

The spring clutch 43 may include the second pulley 44, the case 49, and the core 45. The second pulley 44 may be arranged outside the case 49 and connected through the core 45, and may receive power from the motor 41 as it rotates in conjunction with the first pulley 42 of the motor 41 through the belt 39.

The case 49 may be arranged in the lower part of the spin basket 20, and more specifically, the lower part of the washing tub 10, and may house at least a portion of the spring clutch 43 and protect it from the outside. The case 49 may be a structure fixed to the lower part of the spin basket 20.

Inside the case 49, at least a portion of the core 45 of the spring clutch 43 may be arranged. The core 45 may include the first core 46, the second core 47, and the spring 48. On the outside of the case 49, the second pulley 44 may be arranged. The first core 46 may be connected to the second pulley 44 and rotate together.

The sensor 50 may measure the RPM of the spring clutch 43, and provide it to the processor 90. Hereinafter, one of the methods for the sensor 50 to measure the RPM of the spring clutch 43 will be described as an example.

The RPM of the spring clutch 43 sensed by the sensor 50 may be the RPM of the second pulley 44 that rotates in conjunction with the first core 46 in the spring clutch 43. In this case, the sensor 50 may be a tunnel magnetoresistance sensor, and in the second pulley 44, at least one subject for measurement such as a magnet or a metal material is arranged on a disk, and the sensor 50 may measure the RPM of the subject for measurement based on the current change of the sensor 50 while interacting electromagnetically with the subject for measurement rotating in a fixed location. Alternatively, the sensor 50 may be an optical sensor, and measure the RPM of the second pulley 44 by sensing a marker of the second pulley 44.

In this case, the second pulley 44 of the spring clutch 43 is arranged outside the case 49 of the spring clutch 43 to rotate, and has a disk shape, so that its RPM may be easily measured. Accordingly, the sensor 50 may sense the RPM of the spring clutch 43 as it is attached on the case 49 and measures the RPM of the second pulley 44.

In the spring clutch 43, as the first core 46 and the second core 47 are coupled, the RPMs of the parts constituting them may be different. Thus, the sensor 50 may provide a sensing value, which is measured through a method of measuring the RPM of the second pulley 44 or the first core 46 of which measurement is relatively easy through the aforementioned method, to the processor 90, and the processor 90 may receive the sensing value and identify the RPM of the spin basket 20.

Although not illustrated in the drawings, the sensor 50 may be arranged on the second pulley 44, and sense the RPM of the second pulley 44 in comparison with the case 49 that is relatively fixed. That is, the sensor 50 may sense a relative rotation of the case 49 and the first core 46 of the spring clutch 43. In this case, the sensor 50 may be a tunnel magnetoresistance sensor, and may measure the RPM of the spring clutch 43 based on the current change of the tunnel magnetoresistance generated by a rotation of the second pulley 44. The sensor 50 may measure the RPM of the spring clutch 43 based on the RPM of the second pulley 44 and transmit it to the processor 90, and the processor 90 may identify the RPM of the spin basket 20 based on the RPM of the spring clutch 43.

Meanwhile, measurement methods of the sensor 50 are not limited to the aforementioned method, and any method of a configuration wherein the RPM of the spring clutch 43 is measured and the processor 90 may identify the RPM of the spin basket 20 may be used.

The core 45 may include the first core 46, the second core 47, and the spring 48. The first core 46 and the second core 47 may be coupled and rotate together, or may be separated and rotate respectively. In the surroundings of the coupled portion of the first core 46 and the second core 47, the spring 48 may be arranged, and the first core 46 and the second core 47 may be coupled or separated by the spring 48.

The first core 46 may be selectively coupled with the second core 47, and in a state wherein the first core 46 and the second core 47 are coupled, when the first core 46 rotates in conjunction with the motor 41, the second core 47 may rotate together, and when the first core 46 and the second core 47 are separated, each of them may rotate independently.

To be specific, in a state wherein the motor 41 starts driving or the driving force increases, the first core 46 may rotate in conjunction with the motor 41, and the second core 47 may rotate together with the spin basket 20. The first core 46 may be coupled with the second pulley 44, and the second pulley 44 may rotate together in conjunction with the first pulley 42 of the motor 41 through the belt 39, and rotate the first core 46. Then, the first core 46 may rotate the second core 47 coupled to the spring 48, and the second core 47 may rotate together in conjunction with the rotary shaft 23 of the spin basket 20.

Then, when the driving of the motor 41 is completed or the driving force decreases or the rotating direction of the motor 41 changes, the first core 46 and the second core 47 may be separated, and the power of the first core 46 may selectively be transmitted to the second core 47. Thus, the spring clutch 43 may transmit the power between the motor 41 and the spin basket 20 selectively according to whether the first core 46 and the second core 47 are coupled.

The spring 48 may be arranged on the coupling shaft which is a shaft by which the first core 46 and the second core 47 are coupled and rotate together, and selectively couple or separate the first core 46 and the second core 47. The spring 48 may have a shape that is wound a plurality of times in one direction, and the diameter of the spring 48 may be the same as or smaller than the width of the coupling shaft of the core 45, and its width may change according to the rotating direction.

Specifically, when the first core 46 starts rotating in the same direction as the direction in which the spring 48 is wound, or when the first core 46 rotates in the same direction as the direction in which the spring 48 is wound at an RPM relatively faster than the second core 47, the tightening force of the spring 48 may become stronger, and the spring 48 may couple the first core 46 and the second core 47, and the first core 46 and the second core 47 may rotate together.

In contrast, when the first core 46 rotates in an opposite direction to the direction in which the spring 48 is wound, or when the first core 46 rotates in the same direction as the direction in which the spring 48 is wound at an RPM relatively slower than the second core 47, the tightening force of the spring 48 may become weaker, and the first core 46 and the second core 47 may rotate at different RPMs from each other as the coupling of the first core 46 and the second core 47 becomes weaker.

Thus, the spring clutch 43 may selectively transmit the power of the motor 41 to the spin basket 20 according to the relative RPMs of the first core 46 and the second core 47 and the direction in which the spring 48 is wound.

A slip may occur in the spring clutch 43. A slip is a phenomenon which occurs between the coupling shaft of the first core 46 and the second core 47 and the spring 48, and wherein the first core 46 and the second core 47 rotate independently, and it may occur in situations wherein the tightening force of the spring 48 becomes weaker than a reference value, or a foreign substance is introduced into the coupling shaft, etc. When a slip occurs in the spring clutch 43, the first core 46 and the second core 47 may get to rotate independently.

For example, when the driving of the motor 41 is completed, the RPM of the first core 46 gradually decreases, and in a corresponding manner thereto, the RPM of the second core 47 also gets to gradually decrease. However, when a slip occurs in the spring clutch 43, the RPM of the first core 46 drastically decreases together with the completion of the driving of the motor 41, and the RPM of the second core 47 may decrease relatively later than the first core 46 independently.

In this case, the sensor 50 measures the RPM of the spring clutch 43 based on the RPM of the second pulley 44, and the processor 90 identifies the RPM of the spin basket 20 based on the RPM of the spring clutch 43, and accordingly, when a slip occurs in the spring clutch 43, the processor 90 may incorrectly identify the RPM of the spin basket 20. As a result, the processor 90 determines that a specific cycle process has been completed, and proceeds with the next process based on this, and thus a problem may occur in the operation of the washing apparatus 1, and there is a risk that the user may get hurt. In such a process, the washing apparatus 1 and the controlling method thereof according to the disclosure may detect whether a slip occurred in the spring clutch 43, and thereby prevent a malfunction of the washing apparatus 1.

Figure 3:
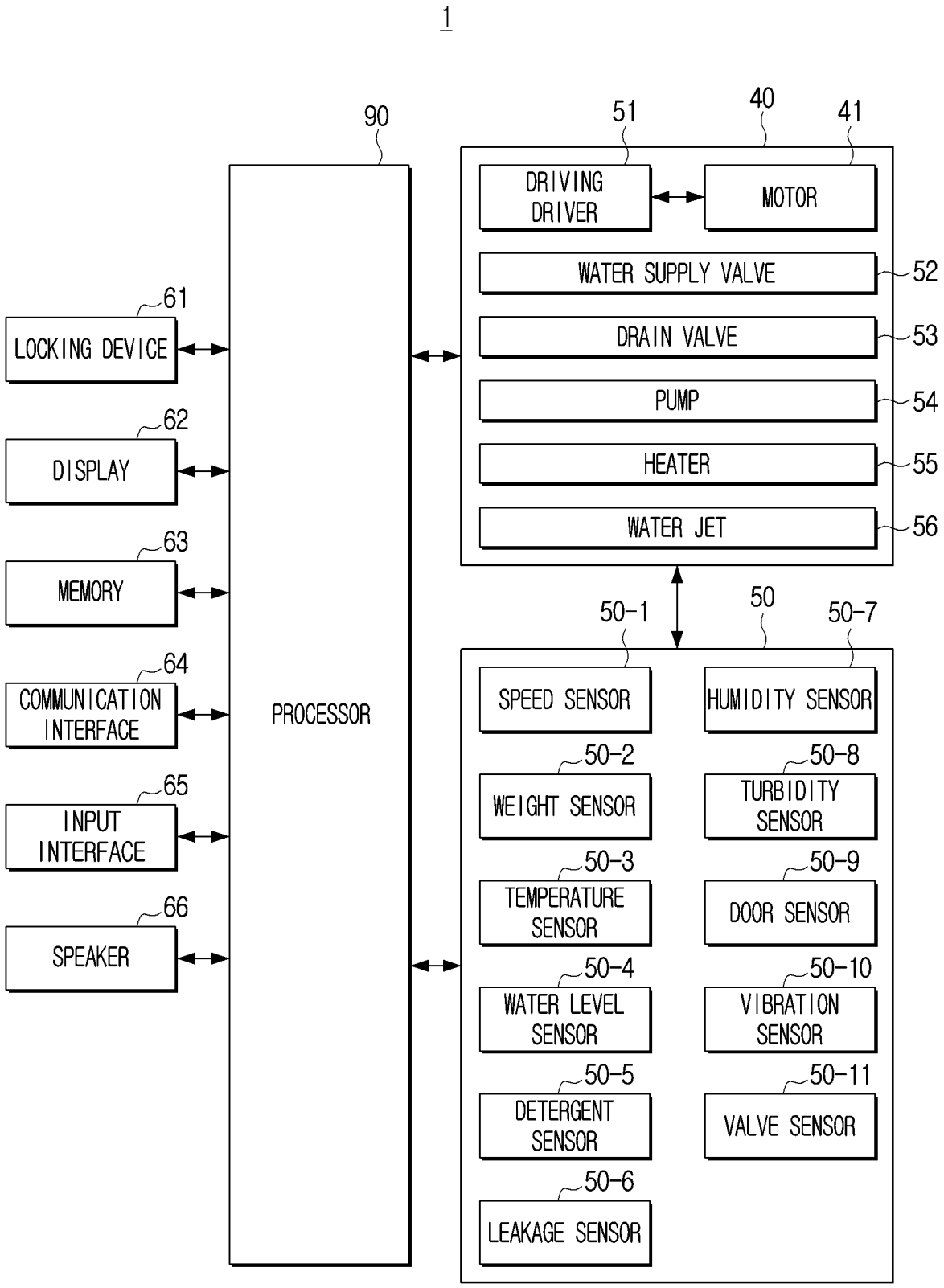
FIG. 3 is a block diagram illustrating in detail a configuration of a washing apparatus according to an embodiment of the disclosure.

FIG. 3 is a block diagram illustrating in detail a configuration of a washing apparatus according to an embodiment of the disclosure.

Referring to FIG. 3, a washing apparatus 1 may include a driving device 40, a sensor 50, a display 62, and a processor 90.

The driving device 40 is a component for performing overall mechanical operations of the washing apparatus 1, and it may perform operations according to control by the processor 90. The driving device 40 may rotate the spin basket 20 of the washing apparatus 1. For this, the driving device 40 may include a driving driver 51 and a motor 41.

The driving driver 51 may refer to a device that can drive the motor 41 by controlling the speed and the torque of the motor 41. The driving driver 51 may control the speed of the motor 41 according to a control signal of the processor 90. Also, the driving driver 51 may control the speed of the motor 41 by using a voltage control method or a frequency conversion method, etc.

The motor 41 may rotate the spin basket 20. Here, the motor 41 may refer to a prime mover that converts energy applied from the outside (e.g.: electric power, etc.) into kinetic energy. For this, the motor 41 may include a stator and a rotor. In the stator, a plurality of wound coils and an internal resistance may be included. In the rotor, a plurality of magnets that generate electromagnetic interaction with the coils may be included. The rotor may rotate by the electromagnetic interaction between the coils and the magnets. The motor 41 may transmit the converted kinetic energy to the rotary shaft 23. Here, the rotary shaft 23 may be coupled with the motor 41 and the spin basket 20, and transmit the power transmitted from the motor 41 to the spin basket 20 to rotate the spin basket 20.

Meanwhile, referring to FIG. 3, the driving device 40 according to one or more embodiments of the disclosure may further include at least one of a water supply valve 52, a drain valve 53, a pump 54, a heater 55, or a water jet 56.

The water supply valve 52 may be opened or closed such that washing water is supplied into or blocked from the inside of the spin basket 20 by control by the processor 90. For this, the water supply valve 52 may be implemented as a solenoid valve, an electromagnet valve, etc. that can be opened or closed by movements of the coils according to an applied electric current.

The water supply valve 52 may be installed between an external water supply pipe and a water supply pipe of the washing apparatus 1. Here, the water supply pipe of the washing apparatus 1 may connect an external water supplying apparatus and the spin basket 20, and in case the water supply valve 52 is in an on state, washing water may be supplied to the inside of the spin basket 20 along the water supply pipe. That is, the water supply valve 52 may perform control such that washing water is supplied into or blocked from the inside of the spin basket 20 according to the state (on or off) of the water supply valve 52.

The drain valve 53 may be opened or closed such that washing water filled inside the spin basket 20 may be drained or maintained by control by the processor 90. For this, the drain valve 53 may be implemented as a solenoid valve, an electromagnet valve, etc. that can be opened or closed by movements of the coils according to an applied electric current.

The drain valve 53 may be installed between a drain pipe of the washing apparatus 1 and an external drain apparatus. Here, the drain pipe of the washing apparatus 1 may connect the spin basket 20 and an external drain pipe, and in case the drain valve 53 is in an on state, washing water filled inside the spin basket 20 may be drained to the external drain apparatus along the drain pipe. That is, the drain valve 53 may perform control such that washing water is drained from or maintained inside the spin basket 20 according to the state (on or off) of the drain valve 53.

The pump 54 may discharge the washing water filled inside the spin basket 20 by using power or pressure by control by the processor 90. In case the drain valve 53 is in an on state, the pulsator 30 may rotate by the motor 41, and the washing water inside the spin basket 20 may be forcibly discharged through a suction pipe and a discharge pipe by the pump 54.

The heater 55 is a component which may, when power is applied according to control by the processor 90, convert the applied electric energy into thermal energy, and transmit the thermal energy to the spin basket 20. For this, the heater 55 may be installed inside the washing tub 10. For example, the heater 55 may boil laundry or clean the spin basket 20 by heating the washing water filled inside the spin basket 20. Also, the heater 55 may dry the laundry inside the spin basket 20 by heating the spin basket 20.

The water jet 56 may include a water jet pump and a nozzle, and may spray the introduced washing water at a high pressure through the nozzle by using the water jet pump, and spray the washing water to a specific location inside the spin basket 20 to remove contaminants remaining inside the spin basket 20. In this case, the water jet 56 may be implemented as a separate device from a spray nozzle for supplying washing water to the inside of the spin basket 20, and it is also possible that the water jet 56 is implemented as one device integrated with the spray nozzle.

The sensor 50 may sense the operational state or the surrounding environment, etc. of the washing apparatus 1, and generate an electric signal regarding the sensing result and output the signal. The sensor 50 may transmit the electric signal to the processor 90, or store the sensing result in a memory 63 of the washing apparatus 1 or an external apparatus. The sensor 50 may sense the operational state or the surrounding environment of the washing apparatus 1 while a cleaning course is being performed, and acquire diagnosis information for the washing apparatus 1. In this case, the sensor 50 may merely sense the operational state or the surrounding environment, etc. of the washing apparatus 1 for acquiring diagnosis information, and generate an electric signal or acquire data as a sensing result, and the processor 90 may acquire diagnosis information by processing the signal or the data received from the sensor 50.

As described above, the sensor 50 according to one or more embodiments of the disclosure may measure the RPM of the spring clutch 43 and provide the RPM to the processor 90, and the sensor 50 performing such a role may be a speed sensor 50-1 that will be described below. Hereinafter, the sensor 50 according to various embodiments of the disclosure will be described by being subdivided in detail according to roles.

The diagnosis information of the sensor 50 may include at least one of the weight of the spin basket 20, whether there is an abnormality in the water supply valve 52 for supplying washing water to the spin basket 20, the temperature of the washing water supplied to the spin basket 20, the flow amount of the washing water supplied to the spin basket 20, whether there is an abnormality in the motor 41, whether there is an abnormality in the drain valve 53 for draining the washing water, the flow amount of the washing water drained from the spin basket 20, or information on the vibration of the washing apparatus 1.

The sensor 50 according to the various embodiments may include at least one of a speed sensor 50-1, a weight sensor 50-2, a temperature sensor 50-3, a water level sensor 50-4, a detergent sensor 50-5, a leakage sensor 50-6, a humidity sensor 50-7, a turbidity sensor 50-8, a door sensor 50-9, a vibration sensor 50-10, or a valve sensor 50-11. The respective sensors included in the sensor 50 may be implemented as separate devices that are physically separated, or it is also possible that the respective sensors are implemented as one device. That is, the sensor 50 is not limited to a case of being implemented as one physical device.

The speed sensor 50-1 may measure the RPM of the spring clutch 43 and provide the RPM to the processor 90 as described above. Also, the speed sensor 50-1 according to the various embodiments may sense the rotation speed, the rotation angle, and the rotating direction, etc. of the motor 41 or the spin basket 20. The speed sensor 50-1 may be implemented as a sensor using a method of sensing the size of load applied to the motor 41 in case the motor 41 rotates the spin basket 20, a method of sensing on/off signals of a hole sensor adjacent to the rotor while the rotor of the motor 41 is rotating, a method of measuring the size of an electric current applied to the driving device 40 or the motor 41 during a rotation of the spin basket 20, etc. However, this is merely an embodiment, and the speed sensor 50-1 may be implemented as sensors by various methods without being limited to the above.

The weight sensor 50-2 may sense the weight of the spin basket 20, and sense the weight of laundry. For example, in case laundry exists inside the spin basket 20, the weight sensor 50-2 may sense the weight of the laundry and the spin basket 20, and identify the difference between the sensed weight and the pre-stored weight of the spin basket 20 as the weight of the laundry.

The weight sensor 50-2 may sense the weight of the spin basket 20 by rotating the spin basket 20 wherein laundry does not exist, and acquire the weight as diagnosis information. For this, the weight sensor 50-2 may sense the weight of the spin basket 20 by using a method of assuming a moment of inertia from the rotation speed and the rotation angle of the motor 41 or the spin basket 20 sensed through the aforementioned speed sensor 50-1, and assuming a weight corresponding to the moment of inertia, etc.

The temperature sensor 50-3 may sense the temperature of the surrounding environment (e.g.: a room temperature) of the washing apparatus 1, or sense the water temperature of the washing water. The temperature sensor 50-3 may further include a temperature adjustment device (e.g.: a thermostat), and here, the temperature adjustment device may detect the heat amount generated from the heater 55, and may perform control such that the temperature of the washing water or the spin basket 20 is maintained as a specific temperature by the heat generated from the heater 55.

The water level sensor 50-4 may sense the water level or the flow amount of washing water. Specifically, while washing water is supplied to the inside of the spin basket 20 or is drained from the inside of the spin basket 20, the water level sensor 50-4 may sense the water level or the flow amount of the washing water. For this, the water level sensor

50-4 may be implemented as a mechanical water level detection sensor, a decompression sensor, a sensor using a semiconductor or a capacitance, etc.

Accordingly, the water level sensor 50-4 may acquire the flow amount of the washing water supplied to the spin basket 20 or the flow amount of the washing water drained from the spin basket 20 as diagnosis information for the washing apparatus 1. Here, the flow amount of the washing water supplied to the spin basket 20 may include water supply amounts, and water supply amounts per time having units such as litter/minute (1/min) (LPM), litter/second (Vs) (LPS), etc., and the flow amount of the washing water drained from the spin basket 20 may include drain amounts and drain amounts per time.

In this case, the flow amount of the washing water supplied to the spin basket 20 and the flow amount of the washing water drained from the spin basket 20 may be used in determining the water supply time and the drain time. For example, the water supply time (min) when washing water is supplied may be determined by dividing the amount of the washing water 1 to be supplied to the spin basket 20 by the water supply amount per time (l/min). Also, the history regarding the flow amount of the washing water supplied to the spin basket 20 or the flow amount of the washing water drained from the spin basket 20 may be used in providing notification information to the user. For example, the history regarding the flow amount of the washing water supplied to the spin basket 20 or the flow amount of the washing water drained from the spin basket 20 may be compared, and in case the water supply amount per time (l/min) decreases to smaller than or equal to a preset value (e.g.: 2 l/min), notification information that inspection or replacement for the water supply pipe or the drain pipe is necessary may be generated and provided to the user.

The detergent sensor 50-5 may detect the remaining amount or the type of a detergent (or a rinsing agent). For example, the detergent sensor 50-5 may consist of a plurality of electrodes, and the remaining amount of a detergent or the type of a detergent may be detected through a resistance value among the plurality of electrodes, and it may be installed in a detergent supply part which is partitioned into a plurality of spaces and wherein a detergent and a rinsing agent can be introduced. Also, the detergent sensor may be implemented as a water level sensor, a turbidity sensor, or a combination thereof.

The leakage sensor 50-6 may sense leakage of washing water. In the water storage part of the washing apparatus 1, washing water leaked from the washing tub 10 may be stored, and the leakage sensor 50-6 may sense the water level of the washing water filled in the water storage part, and detect leakage of the washing water in case the water level is greater than or equal to a preset value. For this, the leakage sensor 50-6 may be implemented as a float switch.

The humidity sensor 50-7 may detect the amount of moisture (water vapor) in the air. For example, the humidity sensor 50-7 may be implemented as an electric resistance type or an electric capacitance type. Specifically, an electric resistance type humidity sensor may detect humidity by detecting a change of electric resistance of a substance of which electric resistance changes when absorbing moisture, and an electric capacitance type humidity sensor may detect humidity by filling a dielectric substance of which dielectric constant changes according to humidity between capacitors, and detecting the electric capacitances on both ends of an electrode.

The turbidity sensor 50-8 may sense the turbidity (the degree of including a foreign substance) of liquid. Specifically, the turbidity sensor 50-8 may detect the turbidity of washing water used in a washing cycle and a rinsing cycle, etc. of the washing apparatus 1. For this, the turbidity sensor 50-8 may include a light emitting part and a light receiving part. For example, the light emitting part may irradiate light, and the light receiving part may receive the light. When light irradiated from the light emitting part passes through the washing water and is received at the light receiving part, the turbidity may be detected from the difference of the amount of the received light. Here, the turbidity may be used in determining the washing time of laundry, the soaking time of laundry, the number of times of rinsing laundry, the introduction amount of a detergent, etc.

The door sensor 50-9 may be electrically connected to the door 5 and/or the locking device 61 of the door 5, and sense whether the door 5 is opened or closed. For example, the door sensor 50-9 may sense the electric potential, the strength of the electric current, or the strength of the magnetic field that vary according to whether a portion of the door 5 contacts the cabinet, and thereby sense whether the door 5 is opened or closed. For this, the door sensor 50-9 may be implemented as a reed switch, a checker switch, etc.

The vibration sensor 50-10 may sense the degree that the washing apparatus 1 vibrates. Specifically, the vibration sensor 50-10 may sense the degree that the washing apparatus 1 vibrates due to a rotating operation of the spin basket 20 while the spin basket 20 rotates in a washing cycle, a spin-drying cycle, etc. For this, the vibration sensor 50-10 may be implemented as a micro electro mechanical systems (MEMS), etc.

The valve sensor 50-11 may sense whether there is an abnormality (or whether it is normal) in the operation of the water supply valve or the drain valve. The valve sensor 50-11 may sense the degree that the water supply valve or the drain valve is opened in a state wherein the water supply valve or the drain valve is on, and in case the opening degree is smaller than a preset value, the valve sensor 50-11 may sense that there is an abnormality in the operation of the water supply valve or the drain valve. Also, the valve sensor 50-11 may sense the degree that the water supply valve or the drain valve is opened in a state wherein the water supply valve or the drain valve is off, and in case the opening degree is greater than or equal to the preset value, the valve sensor 50-11 may sense that there is an abnormality in the operation of the water supply valve or the drain valve. In this case, the processor 90 may acquire whether there is an abnormality in the operation of the water supply valve or the drain valve as diagnosis information through the valve sensor 50-11.

The locking device 61 may limit the opening of the door 5 such that the door 5 is not opened, and may be controlled by the processor 90. Specifically, the locking device 61 may physically limit the moving of the door 5, and may thereby perform control such that the user cannot open the door 5 temporarily. For example, when the spin basket 20 is rotating by the driving of the motor 41, a problem in safety may occur in case the user opens the door 5, and thus the locking device 61 may lock the door 5 at the time of a specific driving operation of the washing apparatus 1 for preventing this. The locking device 61 may be physically or electrically connected with the door 5, and may be electrically connected with the door sensor 50-9 through the processor 90.

The display 62 may display information. Specifically, the display 62 may display image data processed at an image processing part on a display area (or a display). For example, the display 62 may display diagnosis information acquired through the sensor 50 according to control by the processor 90 on the display area. The display area may mean at least a part of the display 62 exposed on one surface of the housing of the washing apparatus 1. At least a part of the display 62 may be coupled to at least one of the front surface, the side surface, the upper surface, or the rear surface areas of the washing apparatus 1 in the form of a flexible display wherein the display can be bent or warped, a foldable display wherein the display can be folded, and a rollable display wherein the display can be rolled. However, this is merely an embodiment, and the display 62 may be implemented in a form of being installed outside but not in a form of being housed inside the washing apparatus 1, and image data may be displayed on an external display connected with the washing apparatus 1 via wire or wirelessly. The display 62 may be implemented in forms such as a liquid crystal display (LCD), a light emitting display (LED), an organic light emitting display (OLED), a micro LED, an electronic ink (e-ink), etc. However, this is merely an embodiment, and the display 62 may be implemented while being modified in various forms without being limited to the above.

The processor 90 may control the overall operations of the washing apparatus 1. For this, the processor 90 may include a random-access memory (RAM), a read-only memory (ROM), a graphic processing part, a main central processing unit (CPU), first to nth interfaces, and a bus. Here, the RAM, the ROM, the graphic processing part, the main CPU, the first to nth interfaces, etc. may be connected with one another through the bus.

When a user command for managing the washing apparatus 1 is received, the processor 90 may perform a cleaning course for cleaning the spin basket 20, and while the cleaning course is being performed, the processor 90 may acquire diagnosis information for the washing apparatus 1 through the sensor 50, and display the acquired diagnosis information on the display 62. Here, the diagnosis information was acquired by sensing the operational state or the surrounding environment, etc. of the washing apparatus 1, and it may be utilized as information for maintenance/management of the washing apparatus 1.

In this case, the processor 90 may perform the cleaning course by supplying washing water to the spin basket 20, and controlling the driving device 40 to rotate the spin basket 20 filled with the washing water. Here, the cleaning course may include a series of operations that are performed for cleaning the inside of the spin basket 20 or the washing tub 10 cleanly by removing the mold, etc. inside the spin basket 20 or the washing tub 10.

In the memory 63, various kinds of instructions, programs, or data important for the operations of the washing apparatus 1 or the processor 90 may be stored. For example, in the memory 63, information acquired by the sensor 50 and data received from an external electronic apparatus may be stored.

The memory 63 may be implemented as a volatile memory such as a static random access memory (S-RAM), a dynamic random access memory (D-RAM), etc., and a non-volatile memory such as a flash memory, a read only memory (ROM), an erasable programmable read only memory (EPROM), an electrically erasable programmable read only memory (EEPROM), etc., a hard disk drive (HDD), or a solid state drive (SSD), etc. The memory 63 may be accessed by the processor 90, and reading/recording/correction/deletion/update, etc. of data by the processor 90 may be performed. The term 'memory' in the disclosure may include the memory 63, a RAM and a ROM inside the processor 90, or a memory card (e.g., a micro SD card, a memory stick, etc.) installed on the washing apparatus 1.

Here, the processor 90 and the memory 63 may respectively be implemented as components that are physically separated, or may be implemented as a single component such as the processor 90 including the memory 63. Also, in the processor 90, a single component or a plurality of components may be implemented as one system. In the memory 63, a single component or a plurality of components may also be implemented as one system.

A communication interface 64 may perform communication with an external apparatus (e.g.: a server, a smartphone, etc.) according to various types of communication methods, and transmit or receive various types of data. For example, the communication interface 64 may transmit information acquired by the sensor 50 to a server (or a smartphone), or receive a control command for driving the washing apparatus 1 from a server (or a smartphone). For this, the communication interface 64 may include at least one of a Bluetooth chip, a wireless-fidelity (Wi-Fi) chip, a wireless communication chip, and a near-field communication (NFC) chip performing wireless communication, or an ethernet module and a universal serial bus (USB) module performing wired communication. In this case, an ethernet module and a USB module, etc. performing wired communication may perform communication with an external apparatus through an input/output port.

An input interface 65 is a component that can receive user commands by various methods from a user, and may transmit a received user command to the processor 90. For this, the input interface 65 may include, for example, a touch panel or keys. For the touch panel, for example, at least one method among a capacitive method, a decompressive method, an infrared method, or an ultrasonic method may be used, and a control circuit for this may be included. The touch panel may further include a tactile layer, and provide a tactile response to the user. The keys may be implemented, for example, through a physical button method, an optical method, or a virtual keypad method coupled with the touch panel. Meanwhile, the input interface 65 may receive a user command through an external apparatus such as a keyboard, a mouse, a smartphone, etc. connected via wire or wirelessly.

The input interface 65 may directly receive a user's voice through a microphone that is housed inside the washing apparatus 1 or installed outside, and convert the user's voice which is an analog signal into a digital signal by a digital conversion part and acquire an audio signal. Also, as an example, the input interface 65 may receive a user's voice which is an analog signal or an audio signal which is a user's voice converted into a digital signal from an external apparatus such as a smartphone connected via wire or wirelessly. In this case, the input interface 65 or the processor 90 may convert the user's voice into text data such as Speech-to-Text (STT) by using various speech recognition algorithms, and analyze the text data to recognize the meaning, and perform a command according to the recognized meaning.

In case the input interface 65 performs wired communication, the input interface 65 may perform communication with an external apparatus through the aforementioned input/output port.

A speaker 66 is housed inside the washing apparatus 1, and may output not only various kinds of audio data for which various processing operations such as decoding or amplification, and noise filtering were performed by an audio processing part, but also various kinds of notification sounds or voice messages directly as sounds.

Figure 4:
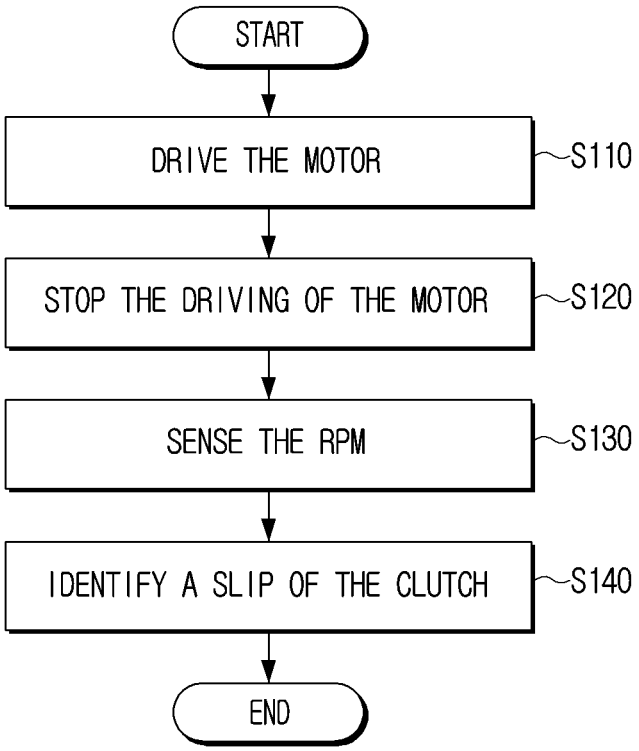
FIG. 4 is a block diagram illustrating a controlling method of a washing apparatus according to an embodiment of the disclosure.

FIG. 4 is a block diagram illustrating a controlling method of a washing apparatus according to an embodiment of the disclosure.

Referring to FIG. 4, a controlling method of the washing apparatus 1 may include the operation of identifying whether a slip occurred in the spring clutch 43.

The controlling method of the washing apparatus 1 may be implemented by proceeding with each operation by the processor 90 of the washing apparatus 1, and it may be implemented as a program including an executable algorithm that can be executed on a computer.

A program including an algorithm may be provided while being stored in a non-transitory computer readable medium. A non-transitory computer readable medium refers to a medium that stores data semi-permanently, and is readable by machines, but not a medium that stores data for a short moment such as a register, a cache, and a memory. Specifically, programs for performing the aforementioned various methods may be provided while being stored in a non-transitory computer readable medium such as a compact disc (CD), a digital versatile disc (DVD), a hard disk, a blue-ray disk, a universal Serial Bus (USB), a memory card, a ROM and the like. Hereinafter, a process after the processor 90 receives an input signal until the processor 90 generates a completion signal will be described in detail with reference to the block diagram in FIG. 3.

When the processor 90 receives an input signal regarding driving of the washing apparatus 1 such as a washing cycle, a rinsing cycle, or a spin-drying cycle, etc., the processor 90 may drive the motor 41 by driving the driving device 40 based on the input signal, in operation S110. When the motor 41 is driven, the first core 46 and the second core 47 are coupled in the spring clutch 43, and power is transmitted to the rotary shaft 23 of the spin basket 20 to rotate the spin basket 20.

When the driving of the motor 41 based on the input signal is completed, the processor 90 may perform control such that the driving of the motor 41 is stopped, in operation S120. When the driving of the motor 41 is stopped, supply of electric currents to the coils wound in the stator of the motor 41 is stopped, and the RPM of the rotor gradually decreases and the rotor stops, and the RPMs of the first pulley 42 and the second pulley 44 may also gradually decrease. Thus, the RPM of the spring clutch 43 gradually decreases together with the stopping of the motor 41, but as the second core 47 is connected to the rotary shaft 23 of the spin basket 20, rotational inertia is applied highly compared to the first core 46, and the RPMs of the first core 46 and the second core 47 may become different. As the RPM of the second core 47 is relatively high, a force is applied in the opposite direction to the direction in which the spring 48 is wound, and thus the winding force of the spring 48 becomes weaker, and the coupling between the first core 46 and the second core 47 may become relatively weak.

When the driving of the motor 41 is stopped, the sensor 50 may measure the RPM of the spring clutch 43, and provide it to the processor 90. The sensor 50 may measure the RPM of the second pulley 44 that is in conjunction with the first core 46, and the processor 90 may identify whether the RPM of the spring clutch 43 is smaller than or equal to a preset first value C1, in operation S130. This operation may be referred to as a first identification operation S135 for distinguishing it from the identification operation that will be described below. The first value C1 may be a value between 0 and 50, and it may preferably be 0.

When the RPM of the spring clutch 43 exceeds the first value C1, the processor 90 may be provided with the RPM from the sensor 50 again, and may repeat the operation in the first identification operation S135 by a preset interval until the measurement value becomes smaller than or equal to the first value C1.

After the driving of the motor 41 is stopped, the coupling between the first core 46 and the second core 47 becomes weak, as described above, and a slip may occur in the spring clutch 43. When a slip occurs in the spring clutch 43, each of the first core 46 and the second core 47 may be separated and rotate independently. Then, the RPM of the first core 46 decreases relatively fast together with the stopping of the motor 41, and in the second core 47, inertia is operated greatly by the spin basket 20, and thus the RPM of the second core 47 may decrease more slowly than the first core 46. In this case, the sensor 50 senses the RPM of the second pulley 44, and thus the processor 90 predicts that the rotation of the spring clutch 43 is smaller than or equal to the first value C1 and the RPM of the spin basket 20 also reached smaller than or equal to a preset safe RPM, but in actuality, the second core 47 may be in a state of rotating fast at greater than or equal to the preset safe RPM. As a result, an error may be generated in the proceeding of the next cycle in the washing apparatus 1, and the user may open the door 5 at a washing completion signal and put his or her hand in the spin basket 20 that is rotating, and thus a problem in safety may occur.

Accordingly, the controlling method of the washing apparatus 1 according to the disclosure may further include the operation of, based on the measurement value of the sensor 50 being smaller than or equal to the preset first value C1 after the stopping of driving of the motor 41 in the first identification operation S135, driving the motor 41 during a preset driving time and identifying whether a slip occurred in the spring clutch 43, in operation S140.

In the operation S140 of identifying whether a slip occurred, it may be sensed whether a slip occurred in the coupling shaft of the first core 46 and the second core 47 of the spring clutch 43 and the spring 48, and the driving of the washing apparatus 1 may be controlled based on this. Specifically, if a slip occurs in the spring clutch 43, the first core 46 and the second core 47 may rotate independently, and a problem in safety may occur if the user opens the door 5 of the washing apparatus 1, and thus the processor 90 may prevent a problem in safety by proceeding with an additional process according to whether a slip occurred through the operation S140 of identifying whether a slip occurred.

Figure 5:
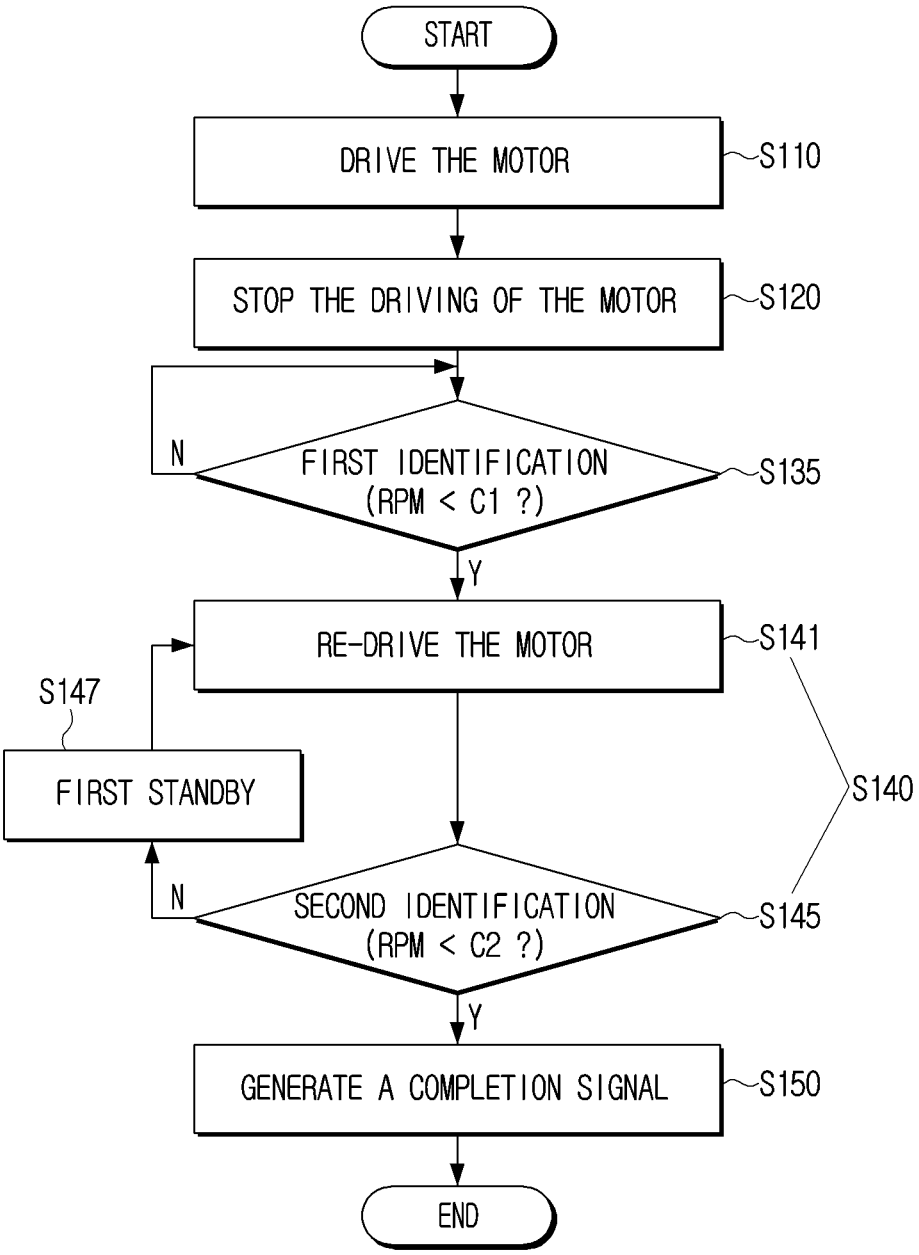
FIG. 5 is a block diagram illustrating a controlling method of a washing apparatus according to an embodiment of the disclosure.

FIG. 5 is a block diagram illustrating a controlling method of a washing apparatus according to an embodiment of the disclosure.

Referring to FIG. 5, a controlling method of a washing apparatus 1 may include an operation of re-driving a motor 41 during the preset driving time, in operation S141, and a second identification operation of identifying whether the measurement value of a sensor 50 is smaller than or equal to a preset second value C2, in operation S145.

Specifically, the operation S140 of identifying whether a slip occurred in the spring clutch 43 may include the operation S141 of re-driving the motor 41 during the preset driving time and the second identification operation S145 of identifying whether the measurement value of the sensor 50 is smaller than or equal to the preset second value C2. The second value C2 may be a value between 20 and 100, and it may preferably be 50.

If the motor 41 is re-driven temporarily, the first pulley 42 and the second pulley 44 may rotate the first core 46 as they rotate, and the spring 48 of the spring clutch 43 may be temporarily tightened, and the first core 46 and the second core 47 may be coupled. Then, in the second identification operation S142, the processor 90 may identify whether the RPM of the first core 46 of the spring clutch 43 is smaller than or equal to the second value C2 through the sensor 50.

The re-driving time of the motor 41 in the re-driving operation S141 of the motor 41 may be a time between 0.5 second and 3 seconds, and it may preferably be 1 second. When the motor 41 is driven shortly for less than 0.5 second, the first core 46 and the second core 47 may not be coupled, and when the motor 41 is re-driven during a time of 3 seconds or longer, a rotation of the spin basket 20 may be induced, and longer time may be spent for the RPM to enter within a safe range, and power consumption may also be generated. Meanwhile, the re-driving time may vary according to the types and driving of the motor 41, the spin basket 20, and the spring clutch 43, and the re-driving time can be any time if it is a time in which the first core 46 and the second core 47 can be coupled and separated appropriately, without being limited to the aforementioned time.

In the second identification operation S145, a slip of the spring clutch 43 may be identified based on the measurement value. Specifically, if a slip occurred in the spring clutch 43 in the operation S120 of stopping the motor 41, the second core 47 keeps rotating, and accordingly, on the moment that the first core 46 and the second core 47 are temporarily connected, the first core 46 may also rotate together correspondingly to the RPM of the second core 47. Thus, in the second identification operation S145, the measurement value may be measured to be higher than the expected RPM value by the re-driving time of the motor 41, and it may be identified that a slip occurred in the spring clutch 43.

When the measurement value exceeds the second value C2 in the second identification operation S145, the processor 90 may identify a slip of the spring clutch 43, and wait during a preset standby time, in operation S147. In this case, the standby operation S147 may be referred to as a first standby operation S147 for distinguishing it from the standby operation S153 that will be described below. The preset standby time may be a time between 20 seconds and 1 minute. Then, after waiting as much as the standby time, the processor 90 may re-drive the motor 41 in operation S141, and go through the second identification operation S145, and identify whether a slip occurred in the spring clutch 43 again, in operation S140.

When a slip did not occur in the spring clutch 43, the measurement value of the sensor 50 may be within the second value C2 which is a predicted range, and the processor 90 may identify that a slip did not occur based on this. Thus, as the spin basket 20 is rotating within the safe RPM range or has stopped rotating, the processor 90 may identify that a slip did not occur in the spring clutch 43, and generate a completion signal, in operation S150.

The completion signal may be a visual or an auditory signal notifying that washing has been completed to the user, or it may be a driving signal of the next operation by the processor 90 for the washing apparatus 1 to proceed to the next operation.

Figure 6:
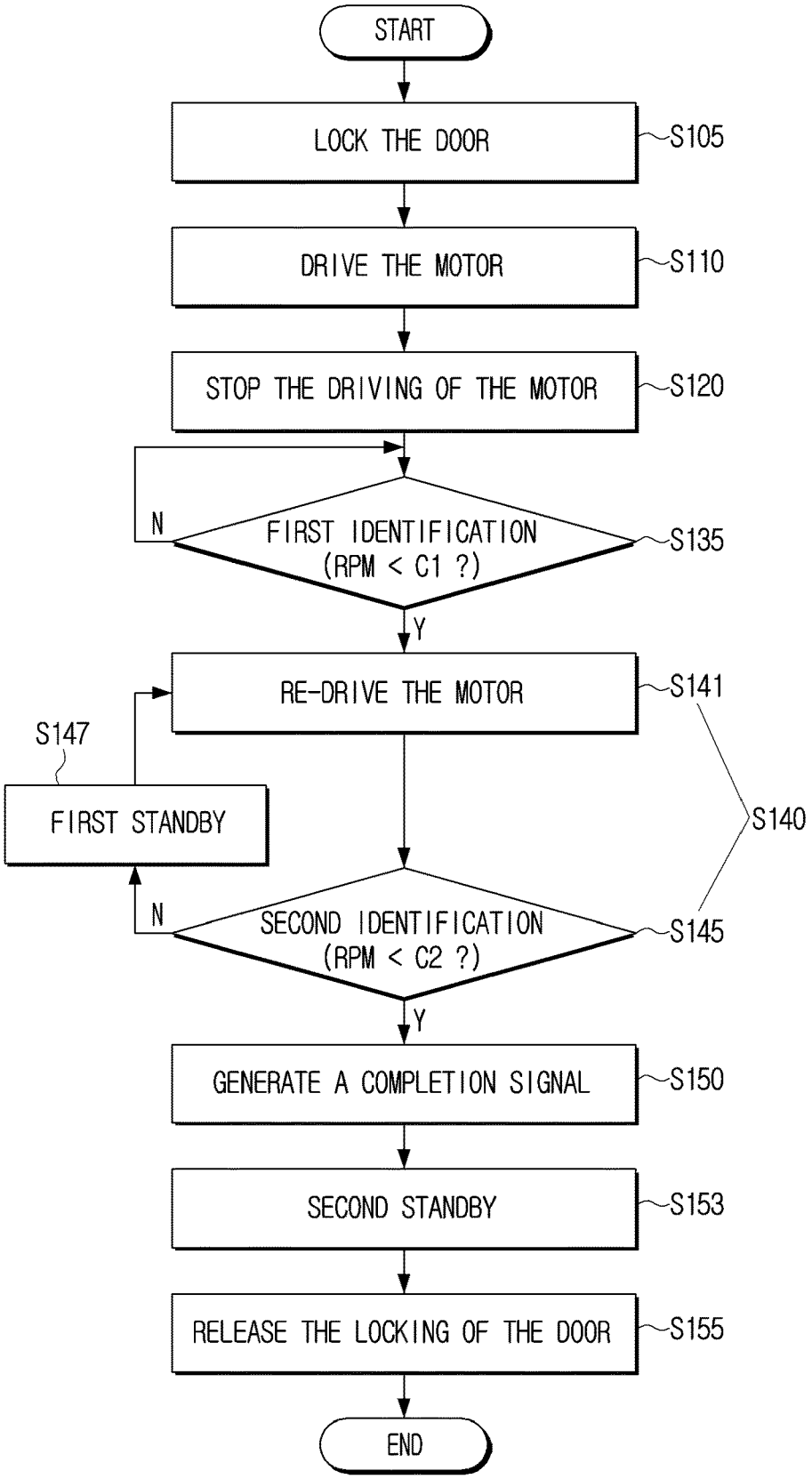
FIG. 6 is a block diagram illustrating a controlling method of a washing apparatus according to an embodiment of the disclosure.

FIG. 6 is a block diagram illustrating a controlling method of a washing apparatus according to an embodiment of the disclosure.

Referring to FIG. 6, a controlling method of a washing apparatus 1 may further include an operation S105 of locking the door, a second standby operation S153, and an operation S155 of releasing the locking of the door 5.

In an embodiment including the locking device 61 of the door 5, in the operation S110 of receiving an input signal and driving the motor 41, the processor 90 may limit the opening of the door 5 by controlling the locking device 61 of the door 5 before driving the motor 41.

Then, after the operation S150 of generating a completion signal, the processor 90 may go through the operation of waiting as much as the preset standby time, i.e., the second standby operation S153, and then the processor 90 may release the locking of the locking device 61 of the door 5, in operation S155.

The preset standby time of the second standby operation S153 may be a time between 1 second and 5 seconds, and it may preferably be 3 seconds. Alternatively, the standby time may be set in consideration of the second value C2 and the weight of the spin basket 20, the amount of laundry, etc.

While the washing apparatus 1 receives an input signal and is being driven, opening of the door 5 is limited to the user, and a problem in safety that the user gets hurt by the rotating spin basket 20 can be prevented. Particularly, considering that the user opens the door 5 of the washing apparatus 1 as the driving of the washing apparatus 1 is completed after a spin-drying cycle, the input signal may be a signal driving a spin-drying cycle of the washing apparatus 1.

Figure 7:
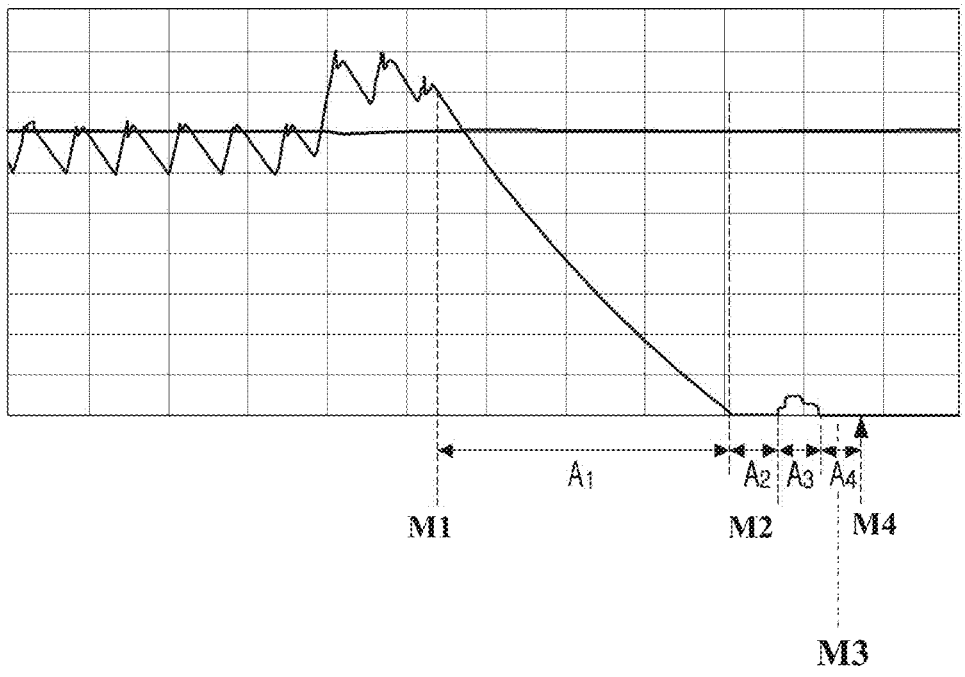
FIG. 7 is a graph illustrating measurement values of a sensor with respect to times according to embodiment of the disclosure.

FIG. 7 is a graph illustrating measurement values of a sensor with respect to times according to an embodiment of the disclosure.

Referring to FIG. 7, the horizontal axis may represent times, and the vertical axis may represent the RPMs of the spring clutch 43 measured by the sensor 50 according to the times.

M1 may be a time point when the processor 90 identifies that driving of the motor 41 by an input signal has been completed, and transmits a signal for stopping the driving of the motor 41 to the driving device 40. Thus, the section before M1 may be the operation S110 wherein the processor 90 drives the motor 41 by an input signal, and an A1 section after M1 may be the operation S120 wherein the driving of the motor 41 has been completed, and the processor 90 performs control such that the driving of the motor 41 is stopped. The length of the A1 section may be the time spent for the driving of the motor 41 to be completed.

During the A1 section, as the motor 41 stops, the RPM of the second pulley 44 measured by the sensor 50 may also gradually decrease. Also, during the A1 section, the sensor 50 proceeds with the first identification operation S135, and the processor 90 may identify that the measurement value of the sensor 50 is smaller than or equal to the first value C1 in the latter part of the A1 section.

An A2 section may be a section of waiting during the preset standby time after the first identification operation S135. The standby time in this case may be set in consideration of the first value C1 and the weight of the spin basket 20, the amount of laundry, etc., and it may preferably be a time between 2 seconds and 4 seconds.

M2 may be a time point when the processor 90 transmits a re-driving signal of the motor 41 to the driving device 40. An A3 section may be the operation S141 wherein the motor 41 in the operation S140 of identifying a slip of the spring clutch 43 is re-driven, and the second identification operation S145.

FIG. 7 is a diagram illustrating a general case wherein a slip did not occur in the spring clutch 43, and referring to FIG. 7, it can be identified that, when the motor 41 is re-driven temporarily, the RPM measured by the sensor 50 does not drastically rise.

Although not illustrated in the drawing, when a slip of the spring clutch 43 occurred, it may be predicted that the measurement value of the sensor 50 will be measured to drastically rise to greater than or equal to the second value C2 during the A3 section, and after waiting as much as the first standby operation S147, the process of re-driving the motor 41 may be repeated.

In the second identification operation S145, it may be identified that a slip of the spring clutch 43 did not occur based on the measurement value of the sensor 50 during the A3 section, and the operation S150 of generating a completion signal may proceed.

An A4 section may be the standby time before generating a completion signal in the operation S150 of generating a completion signal, and M4 may be the time point of generating a completion signal. During the standby time of the A4 section, the RPM of the spin basket 20 may become lower and enter the safe range, and at M3, the locking device 61 of the door 5 may be released.

Thus, in case a slip of the spring clutch 43 was not identified, a completion signal may be generated on any one time point within the A2 section, and the next operation may be entered or the locking device 61 of the door 5 may be released. However, in this case, if a slip of the spring clutch 43 occurs, an error in the driving of the washing apparatus 1 or a problem in safety for the user may occur. However, the controlling method of the washing apparatus 1 according to the disclosure can resolve the aforementioned problem by including an additional operation S140 for identifying a slip of the spring clutch 43 even after the measurement value of the sensor 50 was measured to be the first value C1.

While the disclosure has been shown and described with reference to various embodiments thereof, it will be understood by those skilled in the art that various changes in form and details may be made by therein without departing from the spirit and scope of the disclosure as defined by the appended claims and their equivalents.

What is claimed is:

1. A washing apparatus comprising:

a main body including a door;

a spin basket disposed inside the main body, the spin basket being configured to rotate about a rotary shaft;

a motor configured to provide power to the rotary shaft;

a spring clutch including a first core rotating in conjunction with the motor and a second core rotating in conjunction with the rotary shaft, the spring clutch being configured to selectively transmit power from the motor to the spin basket;

a processor; and a sensor configured to measure revolutions per minute (RPM) of the spring clutch and provide the RPM of the spring clutch to the processor, wherein the processor is configured to:

in response to a driving of the motor according to an input signal being completed, control the motor to stop the driving of the motor; and based on an RPM measurement value received from the sensor after the stopping of the driving of the motor, control the motor to be re-driven for a preset driving time.

2. The washing apparatus of claim 1, wherein the processor is further configured to:

in response to completing the re-driving of the motor, identify whether a slip occurred in the spring clutch based on a measurement value received from the sensor after completing the re-driving of the motor; and based on identifying that the slip did not occur in the spring clutch, generate a completion signal.

3. The washing apparatus of claim 2, wherein the processor is further configured to:

based on identifying that the slip of the spring clutch occurred, control the motor to be driven again for the preset driving time after a preset standby time elapses from a time of the completing of the re-driving of the motor.

4. The washing apparatus of claim 1, wherein the spring clutch comprises:

a case fixed to a lower part of the spin basket; and a spring arranged on a coupling shaft of the first core and the second core, the spring being configured to selectively fix the first core and the second core.

5. The washing apparatus of claim 4, wherein the sensor is further configured to sense a relative rotation of the case of the spring clutch and the first core.

6. The washing apparatus of claim 2, wherein the slip occurring in the spring clutch is identified based on the measurement value of the sensor exceeding a preset second value at a time after completing the re-driving of the motor during the preset driving time.

7. The washing apparatus of claim 2, wherein the processor is further configured to:

based on identifying the slip did occur in the spring clutch, identify whether another slip occurred in the spring clutch again after waiting a preset standby time.

8. The washing apparatus of claim 1, wherein the preset driving time is between 0.5 seconds and 3 seconds.

9. The washing apparatus of claim 2, wherein the main body further includes a locking device of the door, and wherein the processor is further configured to:

based on the input signal, restrict an opening of the door by controlling the locking device to be locked; and based on the completion signal, release the locking of the locking device.

10. The washing apparatus of claim 9, wherein the processor is further configured to:

based on the completion signal, release the locking of the locking device after waiting a preset standby time.

11. The washing apparatus of claim 1, wherein the sensor is arranged on a fixed case of the spring clutch or within a rotating area of the spring clutch.

12. A method performed by a washing apparatus comprising a main body including a door, a spin basket disposed inside the main body and configured to rotate about a rotary shaft, a motor configured to provide power to the rotary shaft, a spring clutch including a first core rotating in conjunction with the motor and a second core rotating in conjunction with the rotary shaft, the spring clutch being configured to selectively transmit power from the motor to the spin basket, a processor, and a sensor configured to measure revolutions per minute (RPM) of the spring clutch and provide the RPM of the spring clutch to the processor, the method comprising:

in response to a driving of the motor according to an input signal being completed, stopping the driving of the motor; and based on an RPM measurement value received from the sensor after the stopping of the driving of the motor, re-driving the motor during a preset driving time.

13. The method of claim 12, further comprising:

identifying the RPM of the spring clutch, wherein the identifying of the RPM of the spring clutch comprises:

identifying whether the RPM is smaller than or equal to a preset first value.

14. The method of claim 12, further comprising:

after the re-driving of the motor during the preset driving time has completed, identifying whether the RPM of the spring clutch is smaller than or equal to a second value; and based on the RPM of the spring clutch being smaller than or equal to the second value, generating a completion signal.

15. The method of claim 14, further comprising:

based on identifying a slip of the spring clutch while the RPM of the spring clutch exceeds the second value, waiting a preset standby time and then driving the motor during the preset driving time.

16. The method of claim 12, wherein the input signal comprises a signal for driving a spin-drying cycle of the washing apparatus.

* * * * *